US007654298B2

(12) United States Patent
Goupil

(10) Patent No.: US 7,654,298 B2
(45) Date of Patent: Feb. 2, 2010

(54) APPARATUS FOR REMOVING A FLEXIBLE FLOOR COVERING FROM A FLOOR

(75) Inventor: Raynald Goupil, 4655, rue, Germaine-Guevremont, Levis, Quebec (CA) G6W 7N6

(73) Assignee: Raynald Goupil, Levis, Quebec (CA)

( * ) Notice: Subject to any disclaimer, the term of this patent is extended or adjusted under 35 U.S.C. 154(b) by 518 days.

(21) Appl. No.: 11/394,103

(22) Filed: Mar. 31, 2006

(65) Prior Publication Data

US 2007/0246167 A1 Oct. 25, 2007

(51) Int. Cl.
*B32B 38/10* (2006.01)

(52) U.S. Cl. ..... 156/584; 156/344; 254/200; 254/203; 254/213

(58) Field of Classification Search ..... 156/344, 156/584; 254/199, 200, 202, 203, 208–211, 254/213, 219, 227, 262; 294/8.6, 103.1, 294/104, 119.1, 902; 269/53, 54.5; 16/5
See application file for complete search history.

(56) References Cited

U.S. PATENT DOCUMENTS 4,533,118 A 8/1985 Thomas et al.
4,560,146 A * 12/1985 Thomas et al. ..... 254/202
4,906,323 A 3/1990 Thomas
4,948,451 A 8/1990 Foltz
4,963,224 A 10/1990 Anderson
5,348,608 A 9/1994 Glenn et al.
5,387,308 A 2/1995 Heavrin
5,415,725 A 5/1995 Scharf
5,454,899 A 10/1995 Glenn et al.
5,456,794 A 10/1995 Barrett
5,505,433 A 4/1996 Carmichael et al.
5,720,844 A * 2/1998 Hanson ..... 156/344
5,909,868 A 6/1999 Galella
6,004,426 A 12/1999 Johnson
6,113,075 A * 9/2000 McMichael et al. ..... 254/203
6,199,616 B1 3/2001 Gillespie
6,613,188 B1 * 9/2003 Berg et al. ..... 156/344
6,840,299 B2 1/2005 Allen et al.
2002/0108720 A1 * 8/2002 Fitterer ..... 156/584
2007/0204955 A1 * 9/2007 Manners ..... 156/344
2007/0222274 A1 * 9/2007 Manners ..... 299/36.1

* cited by examiner

*Primary Examiner*—Mark A Osele
(74) *Attorney, Agent, or Firm*—Alexandre Abecassis; Fasken Martineau DuMoulin LLP

(57) ABSTRACT

The present invention relates to an apparatus for removing a flexible floor covering from a floor. The apparatus has a frame supported on a plurality of castors and a roller supported on the frame for rotational motion substantially parallel to the floor. A drive assembly is coupled to the roller for driving same. A plurality of gripping members are carried on the roller for grippingly engaging a portion of the flexible floor covering and a grip releasing means functioning as a wedge placed between the flexible floor covering and the gripping members is provided to prevent floor covering from winding about the roller as the apparatus is operated.

35 Claims, 14 Drawing Sheets

APPARATUS FOR REMOVING A FLEXIBLE FLOOR COVERING FROM A FLOOR

FIELD OF THE INVENTION

The present invention relates to an apparatus for removing a flexible floor covering from a floor.

BACKGROUND OF THE INVENTION

Soft flexible coverings, such as carpets and resilient floor coverings (i.e. linoleum and vinyl) are generally provided in large rolls, which are unrolled during installation. To ensure that they are properly secured in place, these floor coverings are stapled or glued on the floor or subfloor. As a consequence, such coverings are often difficult to remove from the floor should the need for replacement or renovation arise.

Several attempts have been made to develop special equipment to facilitate the removal of such flexible floor coverings. Examples of such devices can be found in the prior art under U.S. Pat. Nos. 5,387,308, 4,906,323, 5,909,868 and 6,840,299. The foregoing patents generally describe devices for manually detaching a carpet from a floor. These devices all have gripping portions for grippingly engaging the carpet. The carpet may then be detached from the floor by pulling the grip, either directly or via a lever mechanism. The use of these systems tends to require the application of physical strength which is generally not preferred.

U.S. Pat. Nos. 5,348,608 and 5,456,794 generally disclose systems for stripping carpets that include a grip for gripping a portion of the carpet, a base on which is mounted a winch and a wire connecting the grip to the winch. To operate these systems, the winch is activated, pulling the grip toward the base thereby causing the carpet to be stripped off. While generally satisfactory, the configuration of these systems does raise certain safety concerns. More specifically, there is a risk that the wire may snap during use. In addition, these systems need to be relocated constantly to strip the carpet at different locations on the floor. As a consequence, these systems have to be shut down frequently which tends to adversely affect their efficiency.

U.S. Pat. Nos. 6,199,616 and 6,004,426 disclose a carpet stripping apparatus that has a frame, a spool-like roller on which may be wound a portion of stripped carpet, and a gripping member attached to the roll for grippingly engaging a portion of carpet. The roll is supported on the frame for rotational movement about a generally horizontal axis. The carpet stripping apparatus is further provided with a motor for driving rotation of the roll. In operation, the roll is driven to rotate with its gripping member grippingly engaging a portion of carpet to be removed. As the roll rotates, a strip or band-like portion of the carpet is detached from the floor. The band of stripped carpet is wound about the roll. As more carpet is wound about the roll, its diameter and more importantly, its weight increase thereby requiring more operating power and increasing energy consumption. On some premises or job sites, the voltage required to operate these devices may not be conveniently available. In addition, when the roll diameter becomes excessively large, it will be necessary to stop the apparatus to remove the carpet from the roll. This operation tends to be time-consuming and labour intensive.

U.S. Pat. Nos. 4,948,451 and 5,415,725 disclose carpet removing apparatus that generally include a frame, and a pair of rolls rotatably mounted between the spaced apart sidewalls of the frame. The rolls are disposed very close to each other in a tandem arrangement. The space between the rolls is sized so as to receive a portion of carpet. A motor is further provided for driving rotation of one of the rolls. In operation a portion of the carpet is inserted in the space between the rolls and is captively retained therewithin. The motor is then actuated to thereby cause rotation of the driven roll. As the roll rotates, the portion of carpet within the space is pulled away from the floor.

Although this type of device provides an interesting alternative to the earlier described carpet stripping devices, their configuration may pose certain safety hazards for operators of the devices. For instance, loose clothing may get caught between the rolls during operation thereby causing a worksite accident. Additionally, the frames of these machines tend to be relatively heavy to resist the high forces exerted by the rolls. As a result, these devices tend to be difficult to transport and handle.

Therefore, it would be advantageous to have an apparatus for removing flexible floor coverings that is safe, easy to transport and handle and that has relatively modest energy consumption requirements. A carpet stripping device capable of removing a large portion of carpet or other flexible floor covering without the need for constant work stoppage or repositioning would be especially desirable.

SUMMARY OF THE INVENTION

According to a broad aspect of an embodiment of the present invention, there is provided an apparatus for removing a flexible floor covering from a floor. The apparatus includes a frame supported on a plurality of castors to allow rolling motion of the frame along the floor. A roller is supported on the frame for rotational motion relative thereto. The roller has an axis of rotation disposed substantially parallel to the floor when the apparatus is in use. A drive assembly is operatively connected to the roller for rotatively driving the roller. The apparatus further includes gripping means carried on the roller for grippingly engaging a portion of the flexible floor covering. Also provided is a grip releasing means for urging the gripping means to disengage from the portion of the flexible floor covering after the flexible floor covering has been detached from the floor. The grip releasing means is mounted to the frame and disposed adjacent the roller. The grip releasing means is operable to discourage the portion of the flexible floor covering from being wound about the roller.

In an additional feature, the frame includes a pair of spaced apart, first and second longitudinal frame members and a cross-member extending between the frame members to join the first frame member to the second frame member. The roller is mounted for rotation between the first and second frame members.

In still another feature, the roller has a cylindrical body. The cylindrical body has a first end, an opposed second end and an intermediate portion extending therebetween. The intermediate portion has a curved surface defining the circular cross-section of the cylindrical body. The gripping means is carried on the curved surface of the intermediate portion. In a further feature, the gripping means includes a plurality of spaced apart gripping members. Each gripping member extends radially from the curved portion. The gripping members are disposed about the intermediate portion in a plurality of spaced apart rows. The plurality of rows includes at least three rows. Each row includes between five and twenty-five gripping members. Preferably, each row includes between ten and fifteen gripping members. Each gripping member is selected from the group consisting of: (a) a tooth; (b) a barb; and (c) a hook.

In yet another feature, the gripping members are permanently fixed to the roller. In still another feature, the gripping members are releasably mounted to the roller. Each gripping member includes a gripping portion and a fastening portion joined to the gripping portion for attachment to the roller. The curved surface has a plurality of apertures defined therein for receiving the corresponding plurality of gripping members. The plurality of apertures are configured for threaded engagement with the corresponding plurality of fastening portions.

In a further feature, the drive assembly is manually operable. In yet another feature, the drive assembly is motorized. The drive assembly includes an electric drive motor operatively connected to the roller. The electric drive motor is supported on the second frame member.

In additional feature, the grip releasing means includes an elongate plate member having a first longitudinal edge for placement opposite the roller and a second longitudinal edge spaced apart from the first longitudinal edge. The first longitudinal edge has formed therein a plurality of rebates corresponding to the plurality of gripping members. Each rebate is disposed in alignment with its corresponding gripping member and is sized larger than its corresponding gripping member so as to allow its corresponding gripping member to pass therethrough unobstructed during rotation of the roller. The plate member is mounted to extend longitudinally between the first and second frame members. The plate member is disposed adjacent to the roller such that the first longitudinal edge thereof is substantially tangent to a portion of the curved surface of the cylindrical body. When the apparatus is in use, the plate member is slanted downwardly towards the floor. The first longitudinal edge is carried at a first height relative to the floor and the second longitudinal edge is carried at a second height relative to the floor. The first height is greater than the second height. In a further feature, the plate member is mounted generally rearwardly of the roller.

In another feature, the grip releasing means includes a plate member having an elongate portion and at least one projection extending transversely therefrom. The at least one projection is disposed between adjacent gripping members. In an additional feature, the at least one projection includes a plurality of spaced apart projections. The spacing between adjacent projections is aligned with the one gripping member and is sized larger than the one gripping member so as to allow the one gripping member to pass therethrough unobstructed during rotation of the roller. In a further feature, the plate member is mounted to extend longitudinally between the first and second frame members. When the apparatus is in use, the plate member is slanted downwardly towards the floor. In still a further feature, each projection has a proximal end joined to the elongate portion and an opposed free end. When the apparatus is in use, the free ends of the projections are carried at a first height relative to the floor and the proximal ends thereof are carried at a second height relative to the floor. The first height is greater than the second height. In yet another feature, the plate member is disposed adjacent to the roller such that the free ends of the projections are substantially tangent to a portion of the curved surface of the cylindrical body.

In a further feature, the apparatus further includes means for guiding the portion of flexible floor covering towards the intermediate portion of the roller. The guide means is mounted to one of the roller and the frame. The guide means includes a pair of first and second, spaced apart, guide plates. Each guide plate is disposed adjacent one of the ends of the cylindrical body. In another feature, the guide plates are fixed to the frame members. The first guide plate is attached to the first frame member and the second guide plate is attached to the second frame member. In still another feature, the guide plates are fixed to the roller. The first guide plate is attached to the first end of the cylindrical body and the second guide plate is attached to the second end of the cylindrical body. The guide plates are circular.

In an additional feature, the flexible floor covering is selected from a group consisting of: (a) a carpet; and (b) a resilient floor covering. The resilient floor covering is selected from a group consisting of: (a) a vinyl covering; (b) a rubber covering; and (c) a cork covering.

BRIEF DESCRIPTION OF THE DRAWINGS

The embodiments of the present invention shall be more clearly understood with reference to the following detailed description of the embodiments of the invention taken in conjunction with the accompanying drawings, in which.

DETAILED DESCRIPTION OF THE EMBODIMENTS OF THE INVENTION

Figure 1:
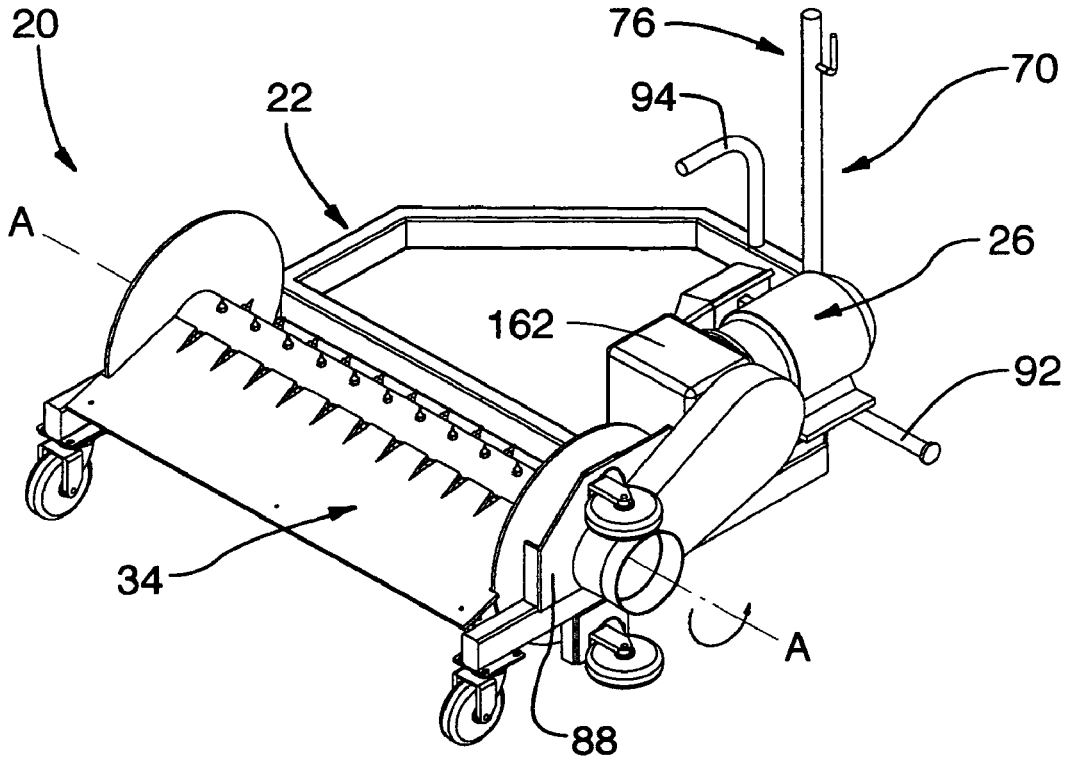
FIG. 1 is a back left perspective view of an apparatus for removing flexible floor covering from a floor according to an embodiment of the present invention, shown in an operative position.

The description which follows, and the embodiments described therein are provided by way of illustration of an example, or examples of particular embodiments of principles and aspects of the present invention. These examples are provided for the purpose of explanation and not of limitation, of those principles of the invention. In the description that follows, like parts are marked throughout the specification and the drawings with the same respective reference numerals.

Referring to FIGS. 1, 2, 3B, 4, 5 and 6, there is shown an apparatus for removing a flexible floor covering from a floor, generally designated with reference numeral 20. The apparatus 20 may be used to remove such flexible floor coverings as carpets and resilient floor coverings, for instance, vinyl, cork covering or the like regardless of whether the floor coverings are glued, stapled, nailed, screwed or otherwise secured to the floor. It will however be appreciated that a floor covering made from any generally flexible material could be removed using the apparatus 20, such as, a floor covering made from a flexible polymer or rubber.

While the apparatus 20 is well suited to remove floor coverings from large surfaces such as those found in commercial or industrial buildings, it can be successfully used in residential dwellings as well.

Figure 16:
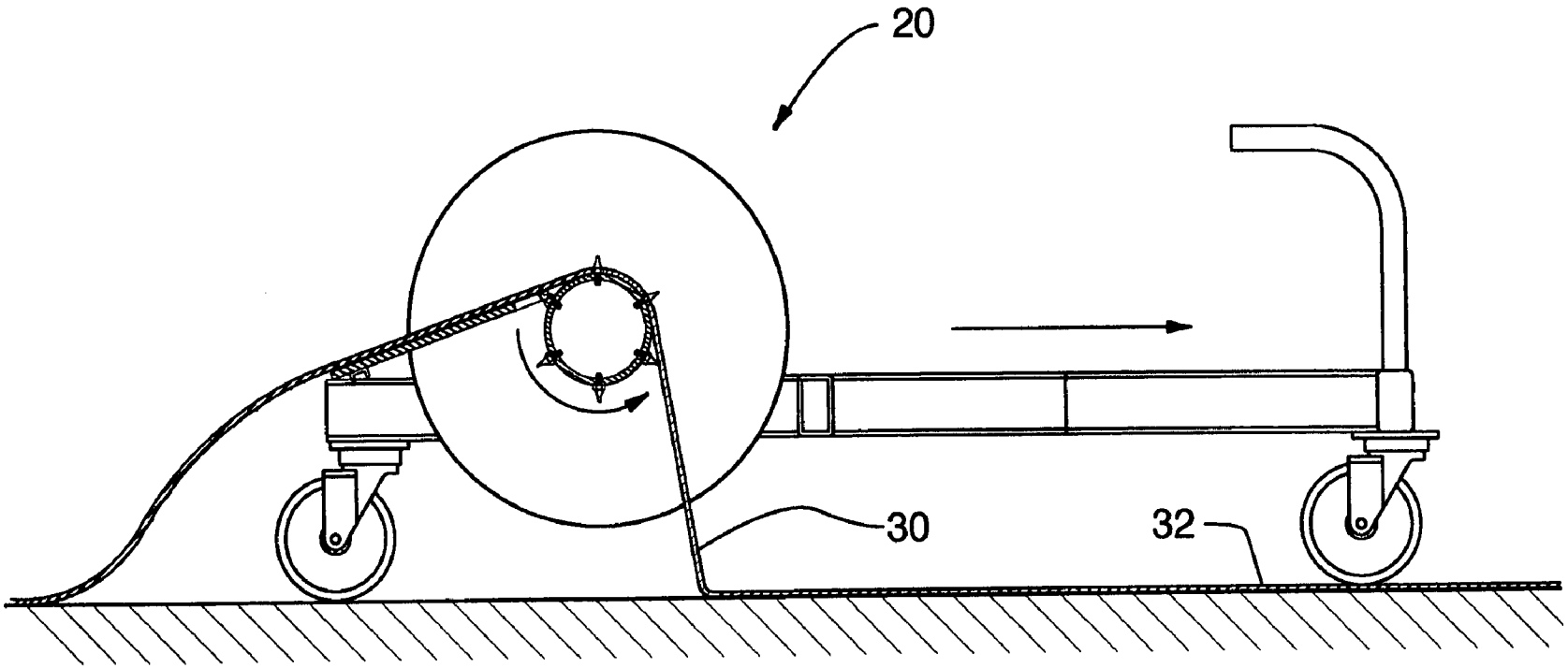
FIG. 16 is a cross-sectional view of an apparatus similar to that illustrated in FIG. 1 shown in operation stripping a flexible floor covering from a floor.
Figure 17:
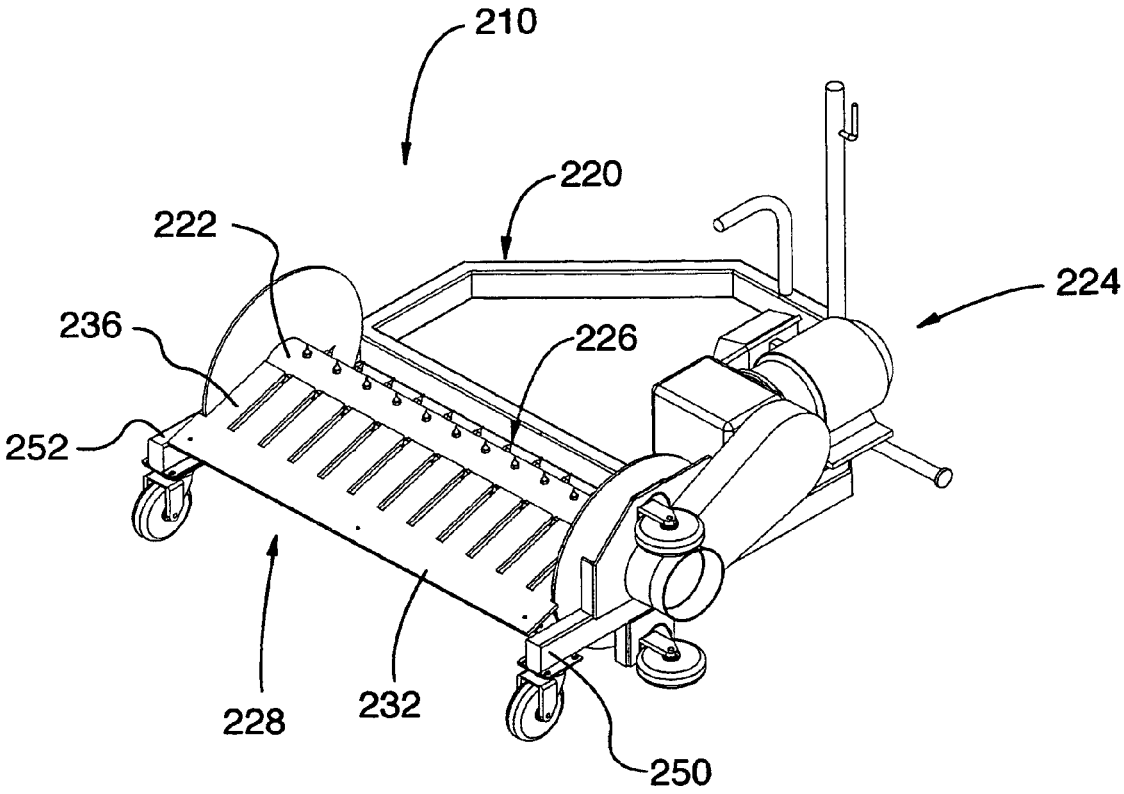
FIG. 17 is a back left perspective view of an apparatus for removing flexible floor covering from a floor according to an alternate embodiment to that illustrated in FIG. 1, shown in an operative position.
Figure 18:
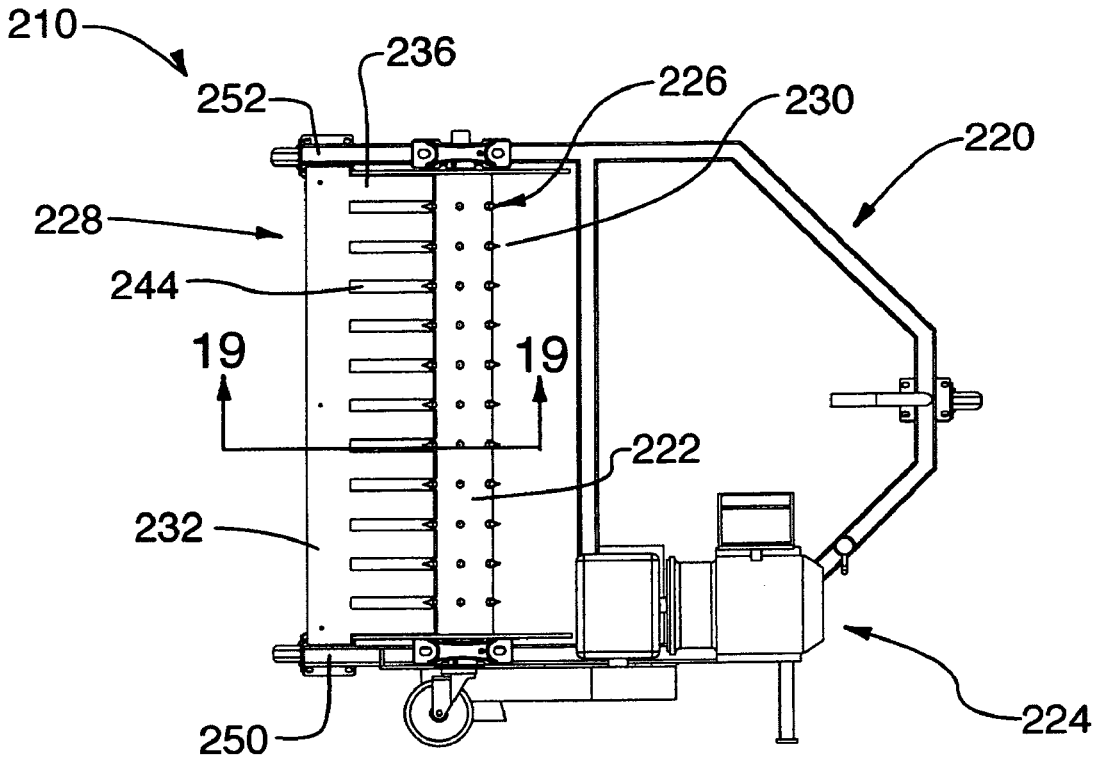
FIG. 18 is a top plan view of the apparatus shown in FIG. 17.

The apparatus 20 generally includes a frame 22, a roller 24 supported on the frame 22 for rotational motion relative thereto, a drive assembly 26 for driving the rotation of the roller 24, gripping means 28 carried on the roller 24 for grippingly engaging a portion of the flexible floor covering 30 to be detached from the floor 32 (best shown in FIG. 16) and grip releasing means 34 mounted to the frame 22 for urging the gripping means 28 to disengage from the portion of flexible floor covering 30.

The frame 22 has a pair of spaced apart, first and second longitudinal frame members 36 and 38 between which are disposed the roller 24 and the grip releasing means 34, a first cross-member 40 joining the first frame member 36 to the second frame member 38, a pair of opposed, intermediate frame members 42 and 44 each connected to a respective frame member 36 and 38, and a second cross-member 46 extending between the intermediate frame members 42 and 44. Each frame member 36, 38 has a terminal (free) end 48 and a proximal end 50. The first cross-member 40 extends between, and is mounted generally perpendicular to, the first and second frame members 36 and 38 at a location closer to the proximal end 50 than to the terminal end 48. Each intermediate frame member 42, 44 is attached to the respective proximal end 50 of the frame member 36, 38. The intermediate frame members 42 and 44 extend away from the proximal ends 50 towards each other and are ultimately connected one to the other by second cross-member 46 extending therebetween.

Figure 3A:
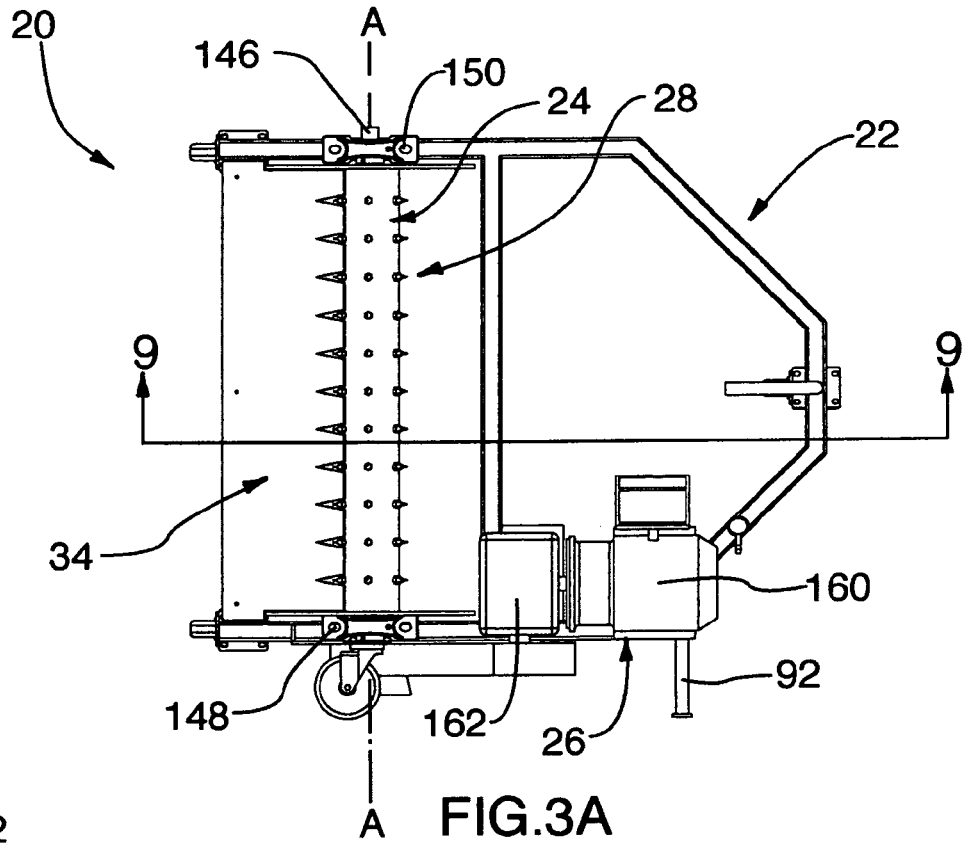
FIG. 3A is a top plan view of the apparatus shown in FIG. 1.
Figure 3B:
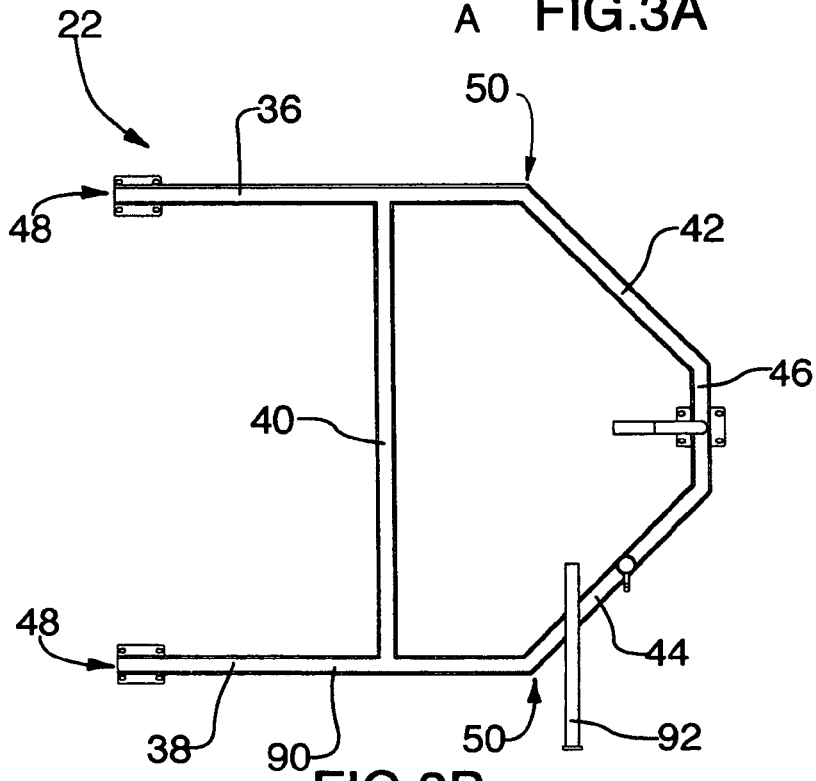
FIG. 3B is a top plan view similar to that illustrated in FIG. 3A with the frame shown in isolation for purposes of clarity.

In this embodiment, the frame members 36, 38, 42 and 44 and the cross-members 40 and 46 are rectangular hollow structural steel (HSS) sections welded together to form frame 22 (best shown in FIG. 3B). However, it will be appreciated that other materials exhibiting similar strength and stiffness characteristics may also be used to similar advantage to fabricate the frame, for instance, aluminium, wood or rigid plastic. Fastening means other than welding may also be used to assemble the frame. For example, the frame members and the cross-members may be joined to each other using conventional fasteners such as screws, nuts, bolts, nails, rivets and the like. In alternative embodiments, the frame may have a unitary construction.

Figure 5:
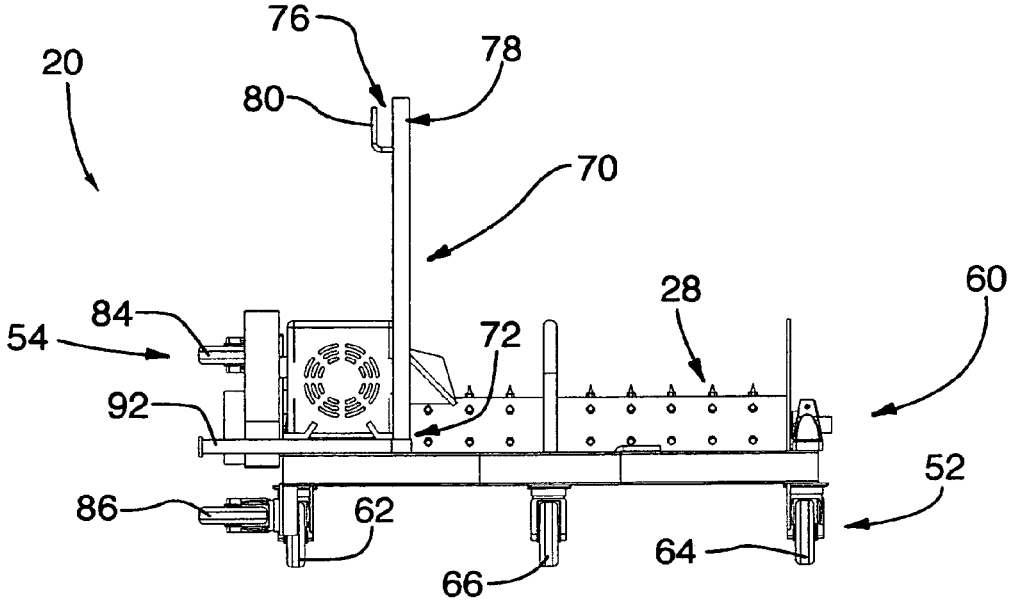
FIG. 5 is a front elevation view of the apparatus shown in FIG. 1.
Figure 6:
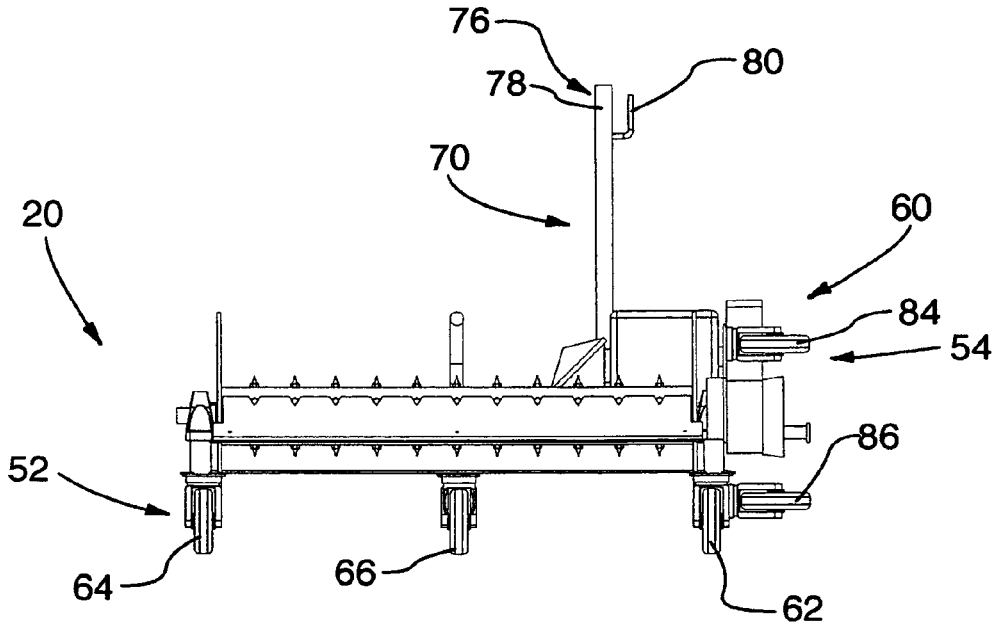
FIG. 6 is a back elevation view of the apparatus shown in FIG. 1.

The frame 22 is provided with first and second set of castors 52 and 54 to allow rolling motion of the apparatus 20 along the floor 32. The first set of castors 52 supports the frame 22 when both frame members 36 and 38 are carried at substantially the same height from the floor 32 and the apparatus 20 is in an operable position 60 (as shown in FIGS. 5 and 6). The first set of castors 54 includes castors 62, 64 and 66 laid out in a generally triangular arrangement. Castors 62 and 64 are mounted beneath the terminal ends 48 of the first and second frame members 36 and 38, while castor 66 is located under the second cross-member 46 midway between the first and second intermediate members 42 and 44.

Figure 7:
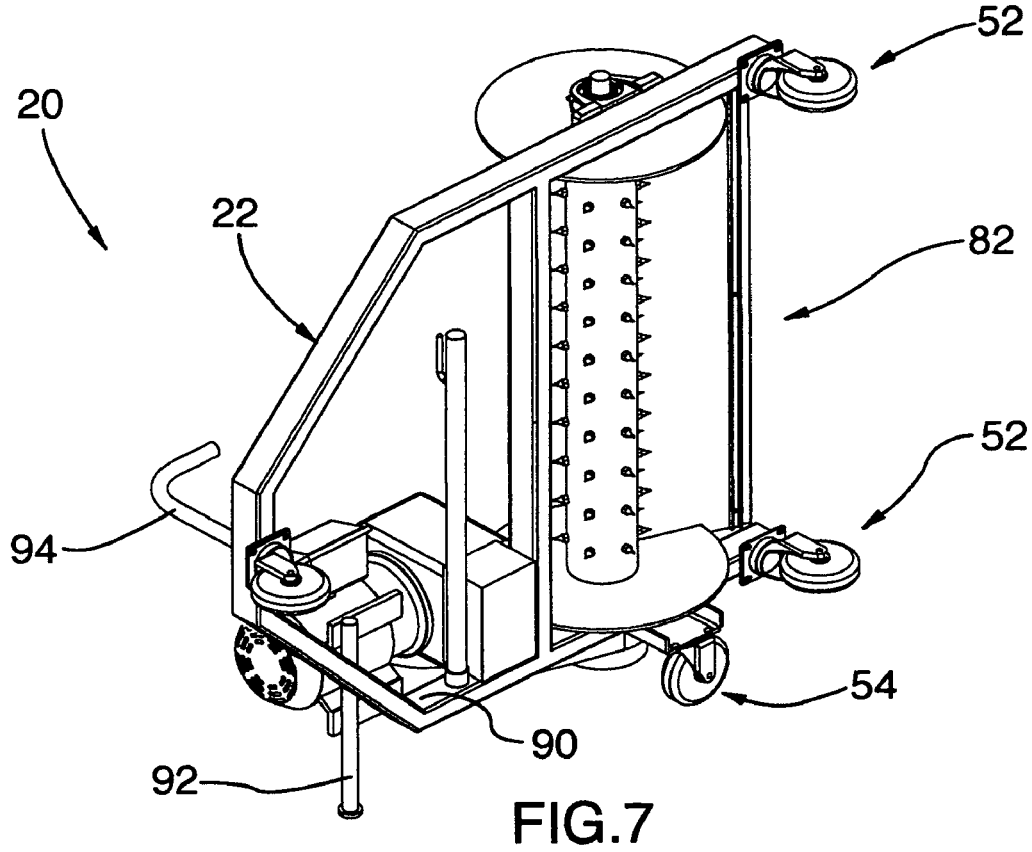
FIG. 7 is a bottom front perspective view of the apparatus shown in FIG. 1.

To assist the operator in controlling the direction of travel of the apparatus 20 when in the operable position 60, a guide pole 70 is provided. The guide pole 70 is mounted to, and extends substantially upwardly from the intermediate frame member 44. The guide pole 70 has a first end 72 releasably connected to the top face 74 of the intermediate frame member 44 and an opposed, second end 76. In this embodiment, the first end 72 is threaded. It is received within a correspondingly threaded base 73 mounted on the top face 74 of intermediate frame member 44. To facilitate transport and reduce the profile of the apparatus 20, the guide pole 70 may be disconnected from the top face 74 of the intermediate frame member 44 and attached to its side face 90 instead (as best shown in FIG. 7).

It should however be appreciated that other means of releasable connection can also be employed successfully. For instance, in an alternative embodiment, with appropriate modification, the first end of the guide pole could be secured to the intermediate frame member with a cotter pin.

Mounted to the second end 76 of the guide pole 70 is a grip or handle 78 to allow the operator to better grasp the pole 70 and guide the apparatus 20 when in use. Optionally, the grip may include a grip-enhancing surface made of rubber or any other suitable material. The second end 76 of the guide pole 70 is also provided with an L-shaped hook 80 upon which may be hung the power cord for the drive assembly 26 to keep it from interfering with the rolling motion of the apparatus 20.

Figure 8:
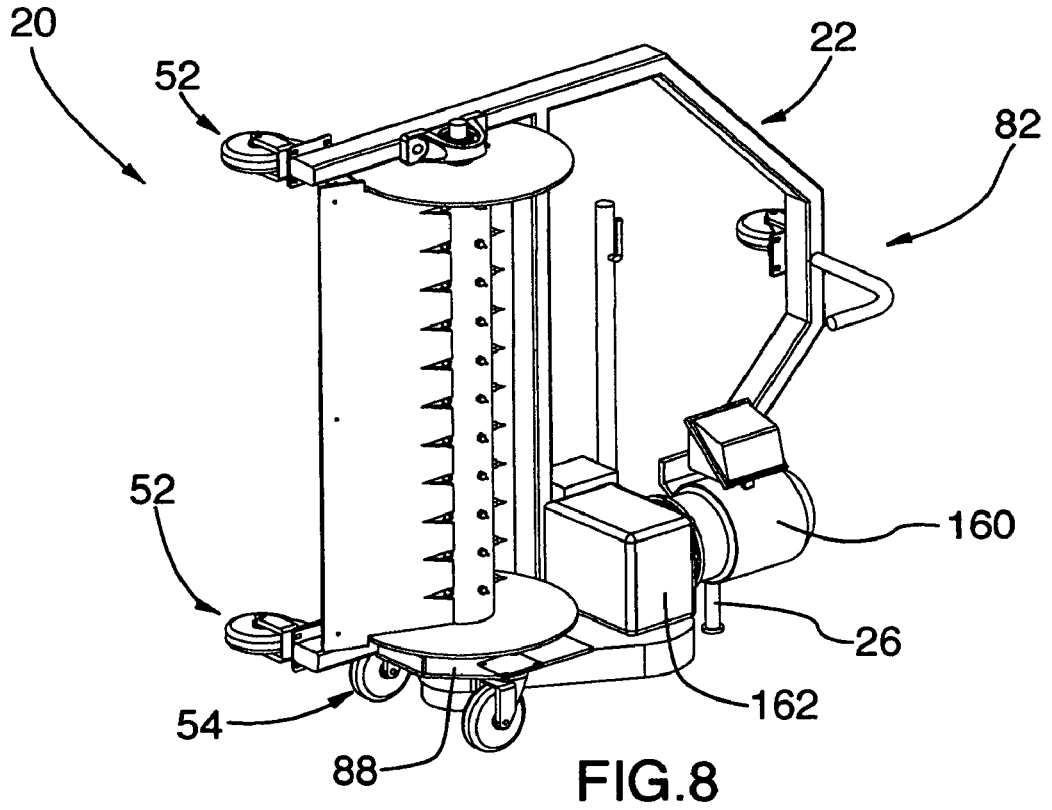
FIG. 8 is a top rear perspective view of the apparatus shown in FIG. 1.
Figure 9:
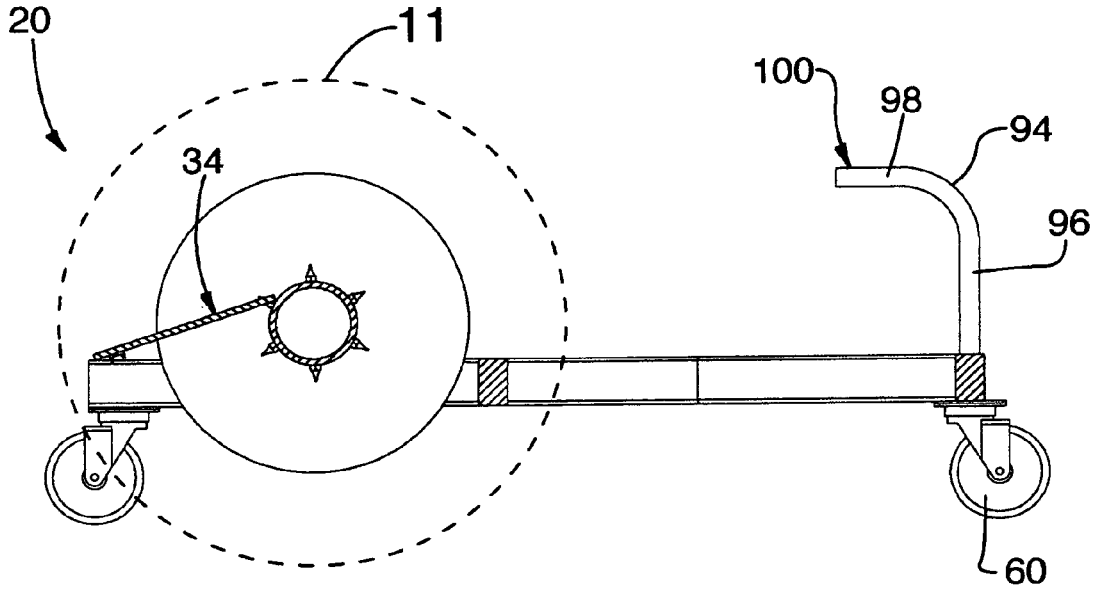
FIG. 9 is a cross-sectional view of the apparatus shown in FIG. 3A taken along line '9-9'.
Figure 10:
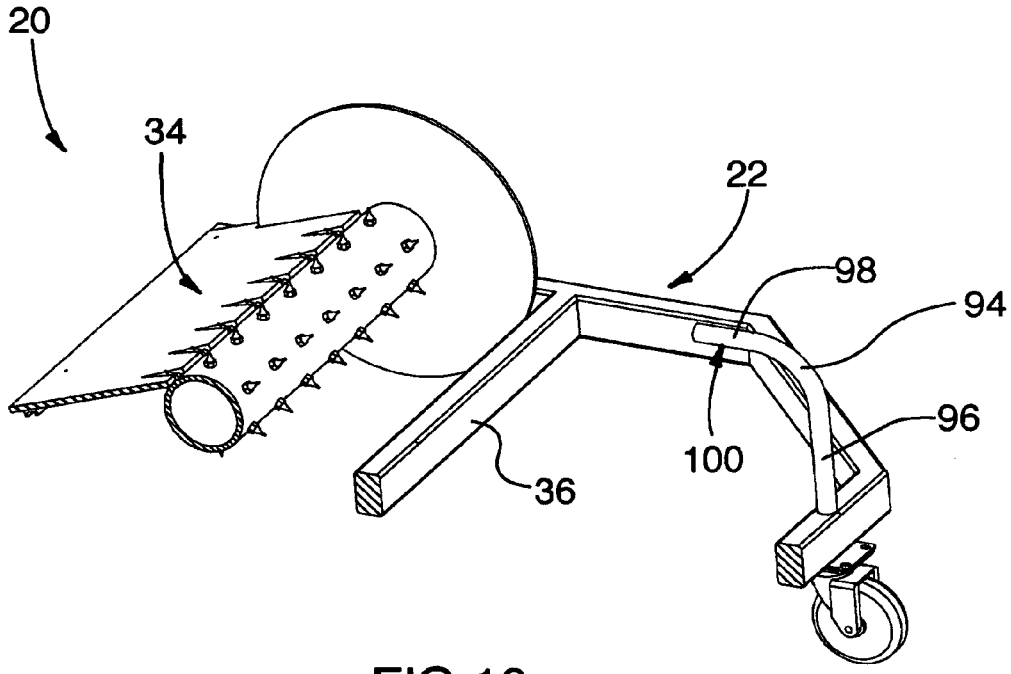
FIG. 10 is a front left perspective view of the apparatus shown in FIG. 9.

The second set of castors 54 is mounted to one side of the frame 22 and is disposed substantially perpendicular to the first set of castors 52. The second set of castors 54 supports the apparatus 20 when the frame 22 is turned on its side during transport and occupies its out-of use position 82 (as shown in FIGS. 7 and 8). The provision of the second set of castors 54 confers enhanced convenience on the apparatus 20 because it allows the lateral profile of the apparatus to be reduced thereby facilitating passage through hallways, corridors or doorways. When in its operable position 60, the apparatus 20 may have a width that exceeds that of a corridor or doorway. To remedy this problem, the apparatus 20 may be turned on it side and supported on the second set of castors 54. In its out-of-use position 82, the width of the apparatus 20 is substantially reduced such that the apparatus may be able to clear a corridor or doorway without difficulty.

The second set of castors 54 includes a pair of spaced apart castors 84 and 86. The castors 84 and 86 are fastened to a mounting plate 88 that is itself welded to the side face 90 of the frame member 38 between the terminal and proximal ends 48 and 50 thereof. The mounting plate 88 is disposed between the roller 24 and the drive assembly 26. When the apparatus is in its operable position 60, the mounting plate 88 can be seen to be oriented generally vertically. Moreover, the castor 84 is carried above the connection site of the roller 24 to the drive assembly 26 while the castor 86 is located below the connection site. Conversely, when in the out-of-use position 82, the mounting plate 88 can be seen to have a generally horizontal orientation and the frame member 36 is carried higher above the floor 32 than frame member 38 (as shown in FIGS. 7 and 8). In that position, both castors 84 and 86 engage the floor 32.

To provide additional support when in the out-of-use position 82, a support rod or leg 92 is provided. The support rod 92 is welded onto the top face 74 of intermediate frame member 44 in a relatively skewed orientation relative thereto. When the apparatus 20 is in the out-of use position 82, the support rod 92 provides a third point of contact with the floor for enhanced stability.

A relatively short, L-shaped member 94 is further provided to facilitate moving the apparatus 20 in its out-use position 82 to the next carpet stripping location or work site. The L-shaped member 94 is mounted to the top face of the second cross-member 46 generally midway between the first and second intermediate frame members 42 and 44. It includes a first arm 96 fixed to the second cross-member 46 and a second arm 98 disposed perpendicular to the first arm 96. The second arm 98 defines a handle 100 which may be grasped by the operator of the apparatus when positioning the apparatus 20 during transport.

Figure 12:
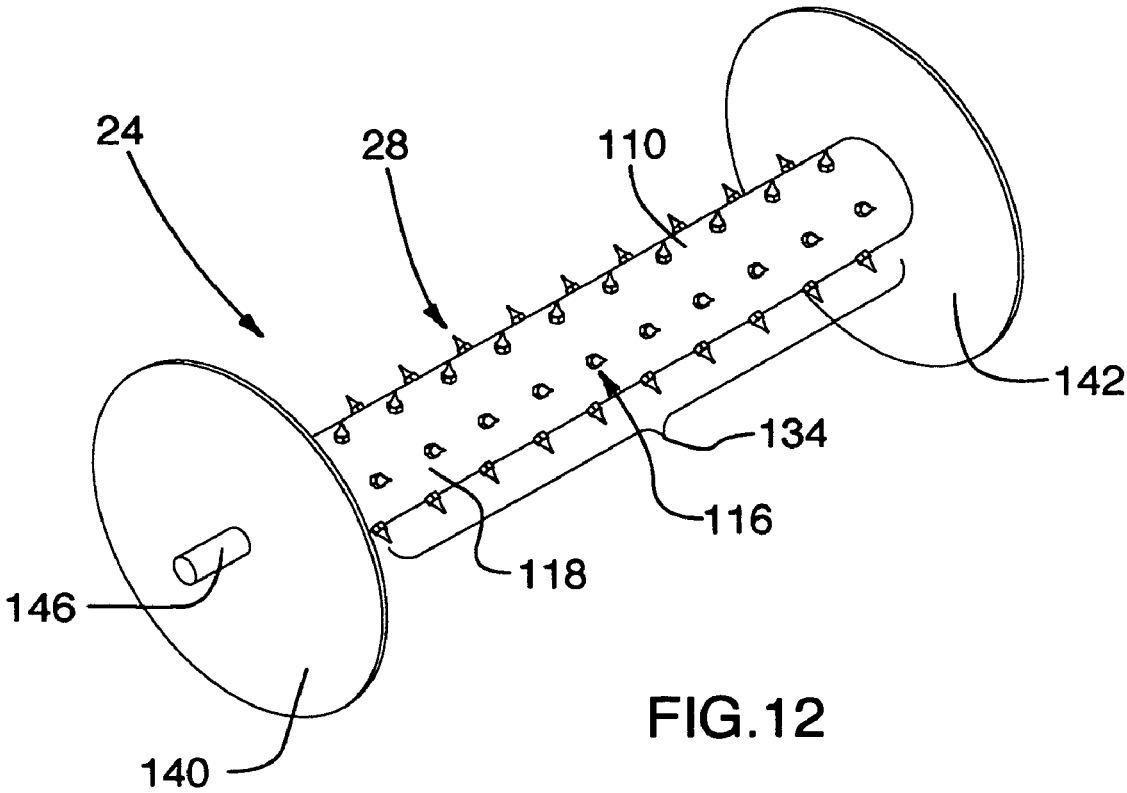
FIG. 12 is a front left perspective view of the roller shown in FIG. 1.
Figure 13:
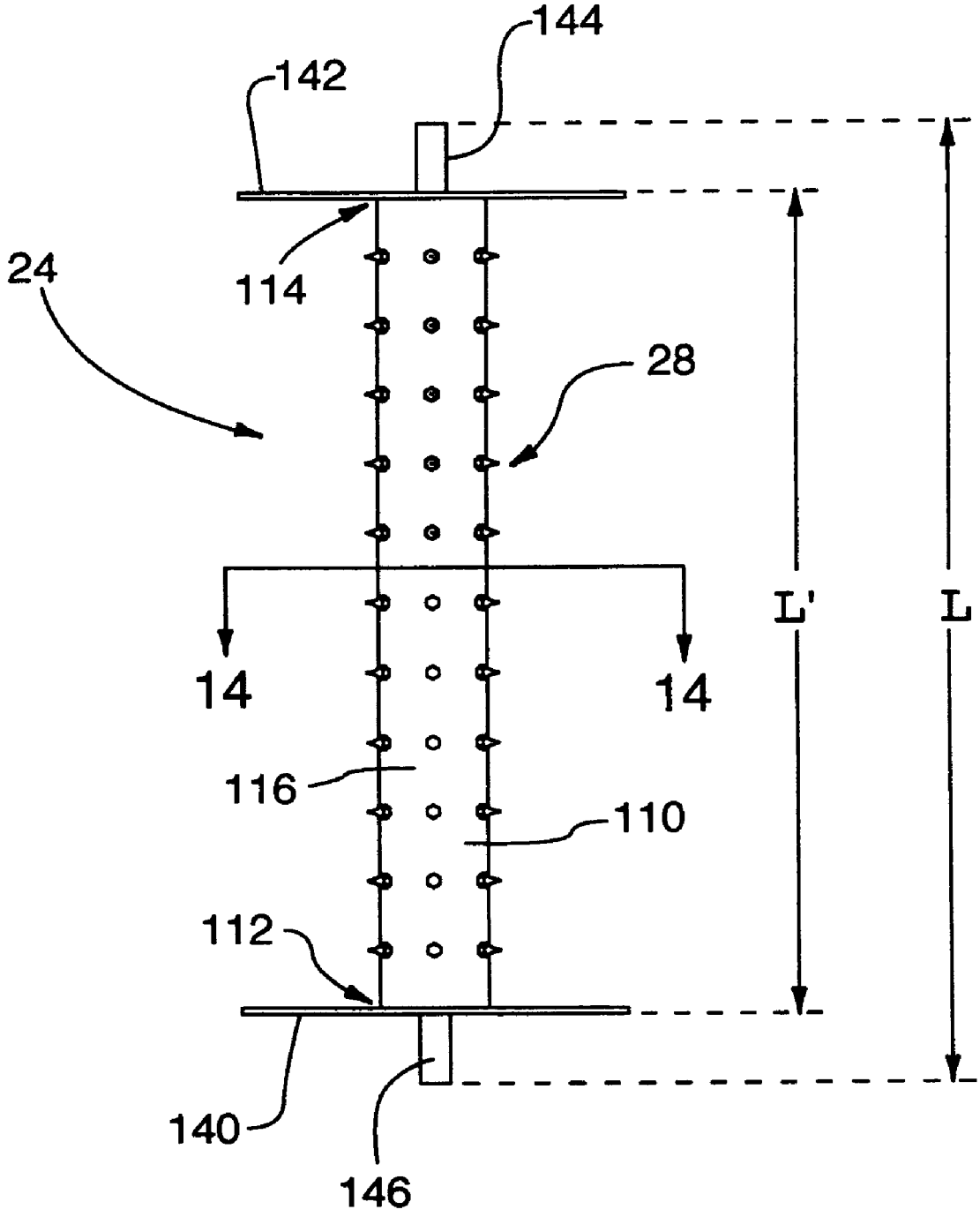
FIG. 13 is a top plan view of the roller shown in FIG. 12.
Figure 14:
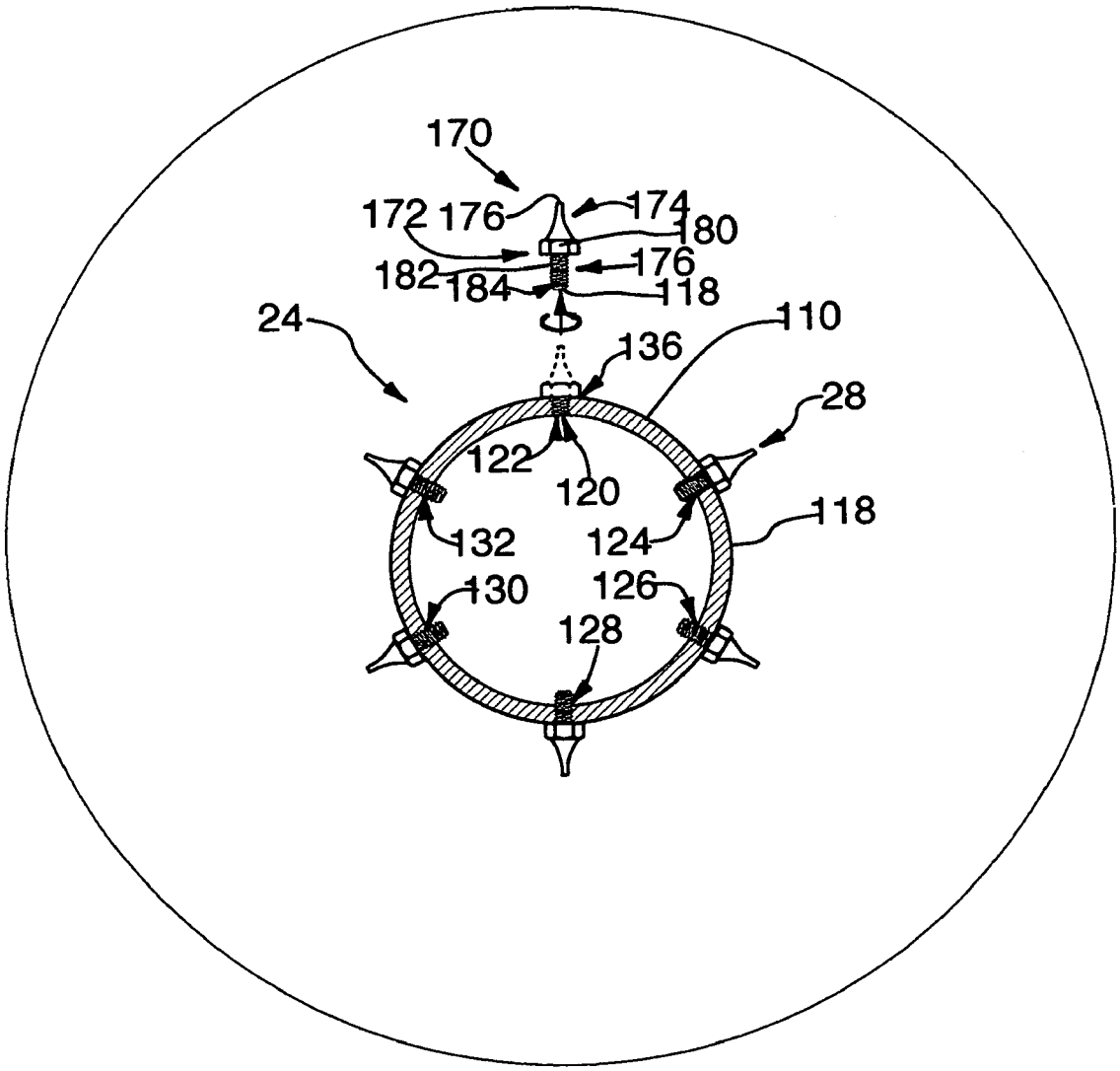
FIG. 14 is a cross-sectional view of the roller shown in FIG. 13 taken along line '14-14'.
Figure 15:
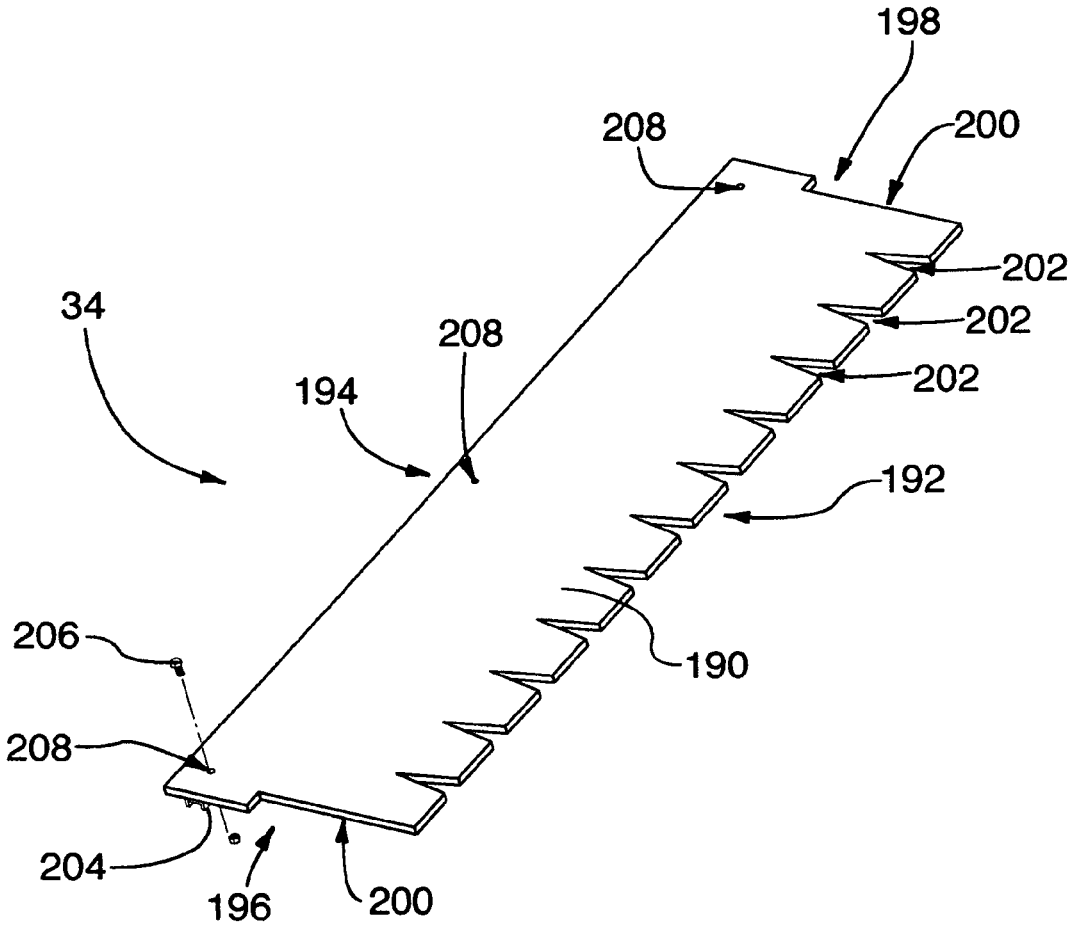
FIG. 15 is a top left perspective view of the grip releasing means shown in FIG. 1.

Now referring to FIGS. 12 to 14, the roller 24 includes a hollow, cylindrical body 110 having a first end 112, an opposed second end 114 and intermediate portion 116 extending between first and second ends 112 and 114. The intermediate portion 116 has a curved surface 118 that defines the circular cross-section of the cylindrical body 110. The curved surface 118 has defined therein a plurality of evenly spaced, threaded apertures 120 laid out in a series of rows 122, 124, 126, 128, 130 and 132 (collectively, "rows 134") that extend between the first and second ends 112 and 114 of the cylindrical body 110. In the present embodiment, the rows 134 are evenly spaced about the circumference of the cylindrical body 110 at 60° degree intervals. As will be explained in greater detail below, the apertures 120 define stations 136 which are adapted to receive and retain a portion of the gripping means 28 therewithin.

Welded to each end 112 and 114 is a circular plate member or disc 140, 142 whose diameter is larger than the diameter of the cylindrical body 110 throughout its intermediate portion 116. In the present embodiment, the diameter of each circular plate member is 16 inches whereas the diameter of the intermediate portion 116 is 5 inches. The plate members 140 and 142 serve to guide the detached portion of flexible floor covering 30 away from the first and second frame members 36 and 38 towards the intermediate portion 116 of the body 110. This tends to prevent the detached portion of the flexible floor covering from interfering with the rotation of the roller 24 during use.

As best shown in FIG. 3B, the roller 24 is pivotally mounted to the first and second frame members 36 and 38 by way of mounting pins 144 and 146. Each mounting pin 144, 146 is welded to, and extends outwardly from, the plate member 140, 142 respectively. The mounting pins 144 and 146 cooperate to define a rotational axis 'A-A' about which the body 110 may be driven to rotate by the drive assembly 26. Preferably, the mounting pins 144 and 146 are made of steel.

In this embodiment, each mounting pin 144, 146 is supported on a pillow-type block bearing 148, 150 and which sits on top of the frame member 36, 38 at a location intermediate the proximal and terminal ends 50 and 48 thereof. This need not be the case in every application. It should be appreciated that an alternate type and/or arrangement of bearings could also be employed. For instance, house flange bearings could be carried on the opposed side faces of the frame members 36 and 38, instead of on their top faces.

While in the present embodiment, the plate members 140 and 142 are attached to the cylindrical body 110 and rotate with the roller 24, it will be appreciated that this need not be the case in all applications. In an alternative embodiment, the plate members could be mounted to the frame members 36 and 38 such that the position of each plate member remains fixed relative to the frame 22. Such plate members could be formed with centrally disposed apertures to accommodate therethrough the passage of the mounting pins 144 and 146. Other modifications to the plate members 140 and 142 are also possible. For instance, instead of being circular, the plate members could be square, rectangular or triangular, or could have a different geometric shape. In still other embodiments, it may be possible to omit the plate members altogether, although this would generally not be preferred.

Figure 2:
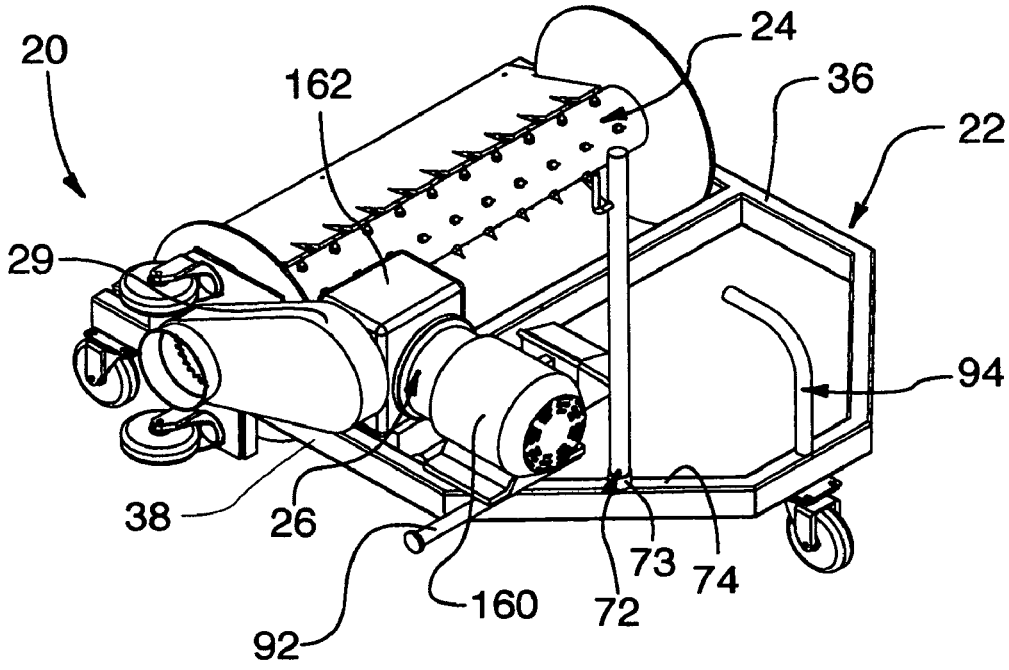
FIG. 2 is a left perspective view of the apparatus shown in FIG. 1.
Figure 4:
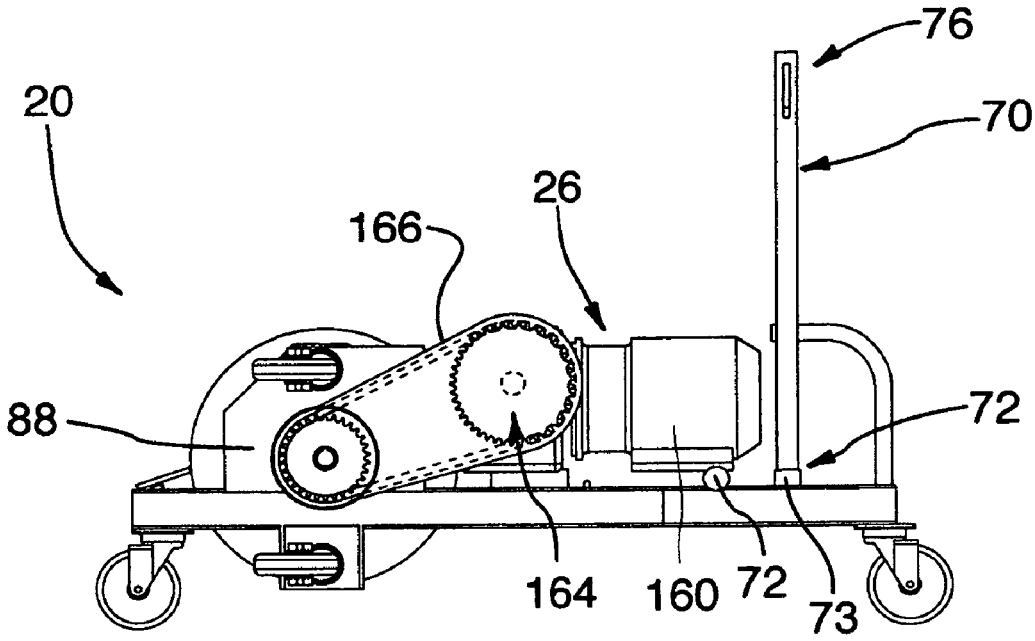
FIG. 4 is a left-side elevation view of the apparatus shown in FIG. 1.

With reference to FIGS. 2 and 4, the drive assembly 26 is now described in greater detail. The drive assembly 26 is carried on the intermediate frame member 44 and includes a drive motor 160, a variable speed gearbox 162 and a chain and sprocket arrangement 164 contained with a protective housing 166. The drive motor 160 is operatively connected to the mounting pin 146 of the roller 24 by way of the gearbox 162 and the chain and sprocket arrangement 164. The drive motor 160 rests on the support rod 92.

Contrary to the motors used in prior art devices such as those described above, the drive motor 160 need not be very powerful. The drive motor 160 may be relatively small and modestly powerful. In the present embodiment, the drive motor 160 is a ¾ h.p. electric motor and runs on an 110 volt circuit. The configuration of apparatus 20 makes the use of such relatively, low power motors possible. More specifically, unlike prior art devices which wind the stripped portion of carpet (for instance) around the roller thereby requiring more power to be drawn from the motor for each subsequent rotation, the apparatus 20 does not cause the carpet to be wound about the roller 24. In the case of apparatus 20, the grip releasing means 34 are operable to disengage the stripped portion of carpet from the roller so as to prevent it from being wound about the roller 24. In the absence of the increased load caused by winding the carpet on the roller, the need for larger more, powerful motors tends to be obviated in the case of apparatus 20.

The provision of variable speed gearbox 162 enables the delivered speed to be stepped down thereby allowing the roller 24 to be rotatively driven at relatively low revolutions. Moreover, the variable speed gearbox 162 permits the rotational speed of the roller 24 to be further adjusted to accommodate the specific type of flexible floor covering and the particular method of attachment therefore. For instance, where glue has been used to adhere carpet to a floor, the gearbox 162 may be actuated in such a way as to deliver greater torque at lower speeds. The increased torque may be useful in overcoming the adhesive force of the glue and detach the carpet from the floor.

While it is generally preferred that the drive assembly be motorized, it will be appreciated that this need not be the case in every application. In an alternative embodiment, the drive assembly could be adapted to allow for manual actuation of the apparatus. For example, a hand crank operatively connected to the roller could be used to urge the rotation of the roller.

As shown in FIGS. 12, 13 and 14, the gripping means 28 are carried on the curved surface 118 of the intermediate portion 116. The gripping means 28 include a plurality of gripping members 170 that are detachably mounted in the corresponding plurality of stations 136 defined in the intermediate portion 84. As a result, the gripping members 170 are laid out in a linear arrangement corresponding to the rows 134. Accordingly, in this embodiment, there are six rows 122, 124, 126, 128, 130 and 132 of gripping members with each row having eleven gripping members 170. However, in alternative embodiments, the gripping means may be modified to have more or less than six rows, but at least three rows of gripping members. Similarly, the number of gripping members per row may also vary depending on the application. Preferably, each row will carry between five and twenty-five gripping members. More preferably, each row will employ ten to fifteen gripping members.

While a multiple row arrangement of gripping members 170 is preferred, it should be appreciated that the gripping members could be disposed along the curved surface 118 differently. For instance, the gripping members could be distributed about the curved surface 118 in a helical pattern or other pattern, or could be randomly positioned along the curved surface 118.

In this embodiment, the gripping member 170 is in the nature of a tooth 172. Each tooth 172 has a gripping portion 174 for grippingly engaging a flexible floor covering 30 and a fastening portion 176 joined to the gripping portion 174 for releasably attaching the tooth 172 to the roller 24. The gripping portion 174 has a generally conoidal structure and tapers at its terminal end to present a relatively, sharp tip 178 that is adapted to engage the flexible floor covering 30. The fastening portion 176 of the tooth 172 has a configuration that resembles that of a bolt. More specifically, the fastening portion 176 has a hexagonal head 180 and a generally cylindrical body 182 connected to the head 180. The hexagonal head 180 is disposed between the gripping portion 174 and the cylindrical body 182. The cylindrical body 182 has helical threading 184 extending about its circumference. The threading 184 is adapted to engage the threaded apertures 120 to allow the tooth 172 to be fastened to the roller 24. To prevent any tooth 172 from becoming loose within its station 136 during use, a ratchet or wrench may be used during assembly to grip the hexagonal head 180 and tighten the threaded connection between the station 136 and the cylindrical body 182. Once fastened to the intermediate portion 116, the teeth 172 can be seen to extend radially from the curved surface 118 of the roller 24 (as best shown in FIG. 14).

Having the teeth 172 releasably connected to the roller 24 tends to facilitate refurbishment or replacement of the teeth 172 during routine maintenance of the equipment. Moreover, this feature tends to enhance the versatility of the apparatus 20 in that the teeth 172 may be changed relatively easily in favour of a gripping member of a different type to suit the removal of a particular floor covering. In this regard, it will be appreciated that teeth 172 may be replaced with other types of gripping members which have specially adapted gripping structures such as hooks, barbs or the like. However, while it is generally preferred that the gripping members be detachably mounted to the roller 24, this need not be the case in every application. In certain applications, it may be desirable to have the gripping members permanently affixed to the roller such as by welding or the like.

Other modifications are also possible. While in the present embodiment, the gripping members 170 are carried on the curved surface 118 of the hollow cylindrical body 110, in alternative embodiments the gripping members may be mounted to other surfaces or structures of a differently configured roller. In this regard, the roller need not be cylindrical or even have continuous surfaces. For instance, the roller could be fabricated with an open framework of members—the members supporting the gripping members thereon.

Referring to FIGS. 3A, 10, 11 and 15, the grip releasing means 34 is now described below in greater detail. As previously mentioned, the grip releasing means 34 serves to discourage the stripped portion of flexible floor covering 30 from being wound about the roller 24 when the apparatus 20 is in use. The grip releasing means 34 carries out its function by urging the teeth 172 to disengage or separate from the stripped portion of flexible floor covering 30 during rotation of the roller 24.

Figure 11:
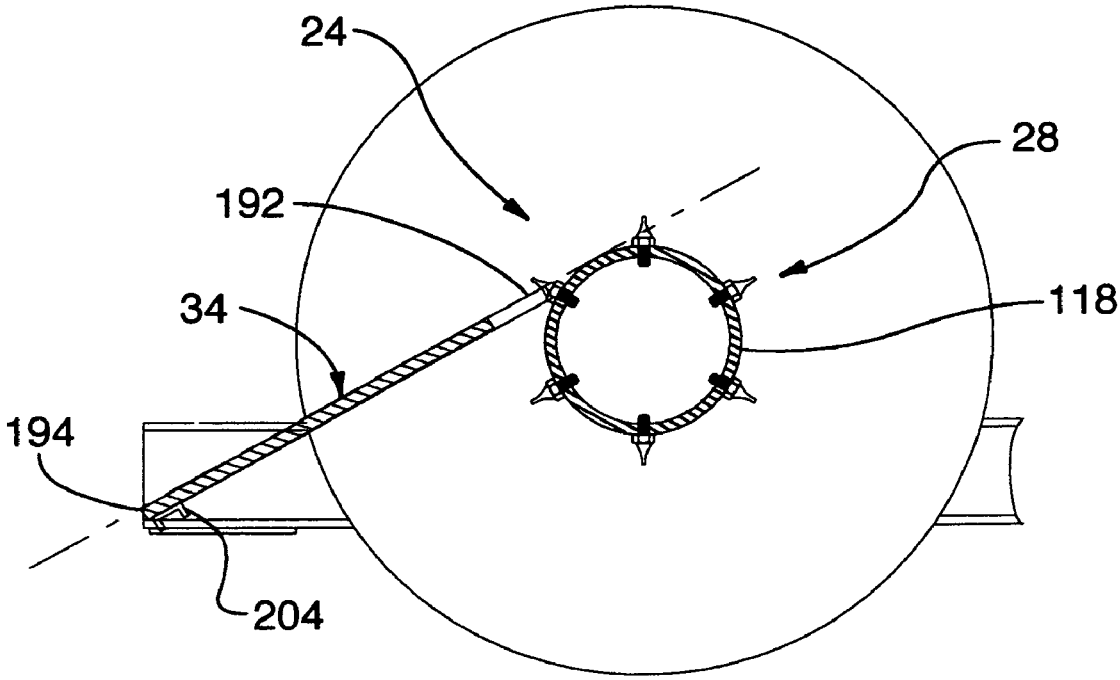
FIG. 11 is a side elevation view of the roller and grip releasing means shown in the encircled portion "11" in FIG. 9.

In this embodiment, the grip releasing means 34 takes the form of a longitudinal, generally rectangular, plate member 190. The plate member 190 is defined by first and second, spaced apart, longitudinal edges 192 and 194 and first and second, spaced apart, lateral edges 196 and 198 that extend between the longitudinal edges 192 and 194. The plate member 190 is mounted lengthwise between the frame members 36 and 38 opposite the roller 24 in an orientation which allows its longitudinal edge 192 to remain tangential or substantially tangential to a portion of the curved surface 118 (as best shown in FIG. 11).

The length of the plate member 190 as measured between its lateral edges 196 and 198 corresponds roughly to the length of the roller 24 as measured between its ends 112 and 114. However, approximately one third of the way between the first longitudinal edge 192 and the second longitudinal edge 194, each of the lateral edges 196, 198 has an indented portion 200 that provides a clearance to accommodate the circular plate member 140, 142.

A plurality of evenly spaced rebates 202 corresponding to the plurality of gripping members 170 in a given row 134 is formed along the first longitudinal edge 192. The rebates 202 are disposed in alignment with the teeth 172 and accordingly, have generally triangular profiles that correspond substantially to those of teeth 172. Furthermore, the rebates 202 are sized slightly larger than the gripping portions 174 of the teeth 172 so as to provide a clearance to allow the teeth 172 to pass through the rebates 202 free of obstruction as the roller 24 rotates about its axis 'A-A'.

The plate member 190 is attached to the frame 22 by a longitudinal C-shaped, channel section 204. The channel section 204 is welded at each end to one of the frame members 36 and 38. The back of channel section 204 is fastened to the underside of plate member 190 adjacent its longitudinal edge 194 using fasteners 206 (such as, screws, bolts, or the like) which are received through apertures 208 defined in the plate member 190 and corresponding openings (not shown) formed in the back of the channel section. When fastened in this fashion, the plate member 190 is preferably mounted with its longitudinal edge 192 carried higher above the floor than its longitudinal edge 194 such that the plate member 190 can be seen to be sloping downwardly towards its longitudinal edge 194 when mounted to the frame 22. In an alternative embodiment, the longitudinal edges 192 and 194 could be carried at the same height above the floor.

In use, a given row 134 of teeth 172 will grippingly engage a portion of flexible floor covering 30. As the roller 24 is driven to rotate, the portion of flexible floor covering 30 gripped by the row of teeth 172 is pulled away from the floor 32. The rotational movement of the roller 24 causes the row 134 to meet the grip releasing means 34 and to drive the plate member 190 between the portion of the flexible floor covering 30 and the teeth 152. More specifically, the longitudinal edge 194 of plate member 190 abuts that part of the curved surface 118 that carries row 134. The teeth 172 are urged to pass through the rebates 202, but the portion of flexible floor covering 30 is held back by the plate member 190. As a result, the teeth 172 are urged to disengage from the portion of flexible floor covering 30. In this way, the plate member 190 acts as a wedge to separate the floor covering 30 from the teeth 172. No longer attached to teeth 172, the stripped portions of flexible floor covering 30 slide along the plate member 190 toward the first longitudinal edge 192 and ultimately, accumulate on the floor 32 behind the apparatus 20.

To keep the weight of the apparatus 20 relatively low, the plate member 190 is preferably made of a light, rigid plastic. However, it will be appreciated that other light-weight, rigid materials could also be employed to similar advantage.

One configuration of the grip releasing means 34 has been described above. However, the grip releasing means may take a variety of forms without departing from the principles of the present invention. Other configurations using plates, bars and the like could be used to carry out the wedge-like function of the grip releasing means. For instance, it may be possible to replace the plate member 190 with an alternative plate member having one or more finger-like projections for urging the teeth to disengage from the portion of flexible floor covering.

One such embodiment is shown in FIGS. 17 to 20 wherein an alternative apparatus is designated with reference numeral 210. The apparatus 210 is generally similar to apparatus 20 in that includes a frame 220, a roller 222, a drive assembly 224, gripping means 226 (in the nature of gripping members 230 similar to gripping members 170) and grip releasing means 228. The frame 220, the roller 222, the drive assembly 224 and the gripping means 226 are similar in both construction and configuration to their respective counterpart elements in apparatus 20 and are operatively connected to each other in generally the same manner, such that no additional description of these elements is required. However, the apparatus 210 differs from the apparatus 20 in that the grip releasing means 228 is defined by an alternate plate member 232. The plate member 232 has an elongate portion 234 and a plurality of spaced apart, finger-like projections 236 which extend transversely of the elongate portion 234. Each of the projections 236 has a proximal end 238 joined to the elongate portion 234 and an opposed free end 240. While in this embodiment, the plate member 232 has twelve projections 236, it will be appreciated that the number of projections may be varied to suit the particular application.

In this arrangement, the configuration of the projections 236 and the spacing 244 between adjacent projections 234 imparts a generally crenellated appearance to the plate member 232. Moreover, the plate member 232 is configured such that the spacing 244 between adjacent projections 236 is alignable with the gripping members 230 in a given row. The spacing 244 is sized to provide a clearance to allow the gripping members 230 to pass through free of obstruction as the roller 222 rotates about its axis 'A-A'.

Figure 19:
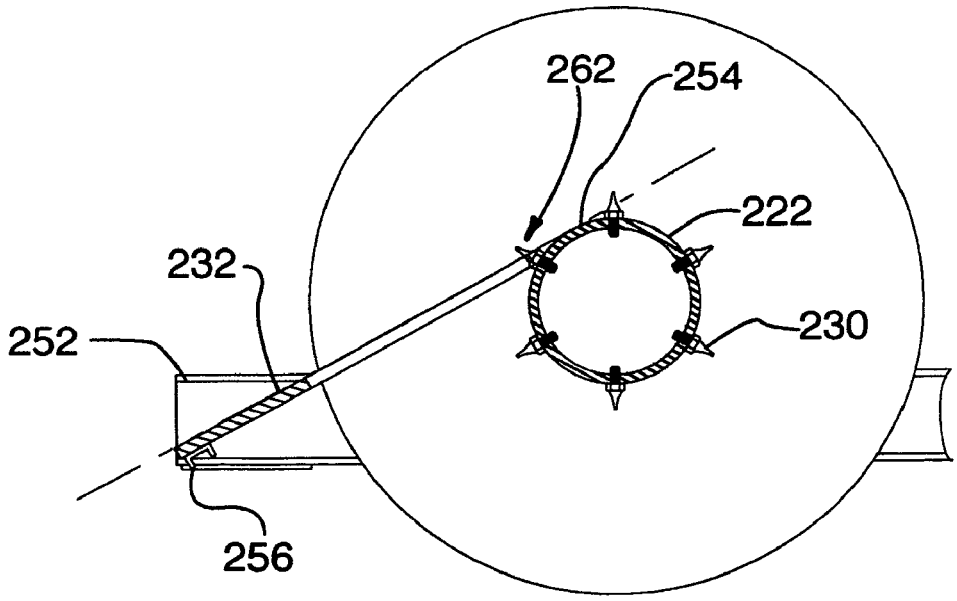
FIG. 19 is a enlarged cross-sectional view of the apparatus shown in FIG. 18 taken along line '19-19'.
Figure 20:
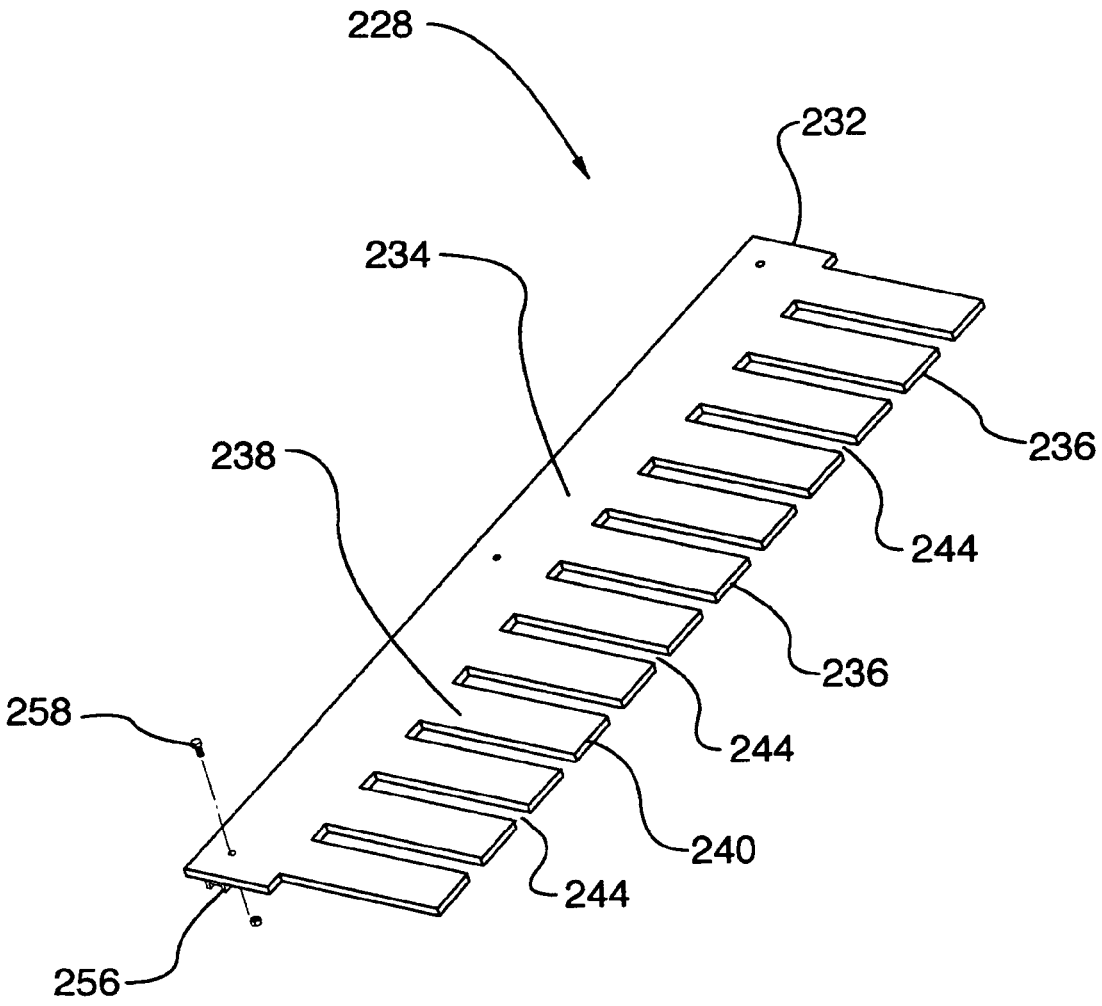
FIG. 20 is a top left perspective view of the grip releasing means shown in FIG. 17.

In similar fashion to plate member 190, plate member 232 is mounted lengthwise between frame members 250 and 252 opposite the roller 222 in an orientation which allows the projections 236 to remain tangential or substantially tangential to a portion of the curved surface 254 of the roller 222 (as best shown in FIG. 19). Moreover, the plate member 232 is attached to the frame 220 by a longitudinal C-shaped, channel section 256 similar to channel 204. The channel section 256 is welded at each end to one of the frame members 250 and 252. The back of channel section 256 is fastened to the underside of plate member 232 along its elongate portion 234 using fasteners 258 (such as, screws, bolts, or the like) which are received through apertures 260 defined in the plate member 190 and corresponding openings (not shown) formed in the back of the channel section. When fastened in this fashion, the plate member 232 is preferably mounted with the free ends 240 of the projections 236 carried higher above the floor than the proximal ends 238 thereof such that the plate member 232 can be seen to be sloping downwardly towards the elongate portion 234. In an alternative embodiment, the proximal and free ends 238 and 240 could be carried at the same height above the floor.

In use, the plate member 232 functions much in the same way as plate member 190. A given row 262 of gripping members 230 will grippingly engage a portion of flexible floor covering 30. As the roller 222 is driven to rotate, the portion of flexible floor covering 30 gripped by the row 262 of gripping members 230 is pulled away from the floor 32. The rotational movement of the roller 222 causes the row 262 to meet the grip releasing means 228 and to drive the plate member 230 between the portion of the flexible floor covering 30 and the gripping members 230. More specifically, the free ends 240 of the projections 236 abut that part of the curved surface 254 that carries the row 262 of gripping members 230. The gripping members 230 are urged to pass through the spacing 244, but the portion of flexible floor covering 30 is held back by the plate member 232. As a result, the gripping members 230 are urged to disengage from the portion of flexible floor covering 30.

In the embodiments described above, the plate members 190 and 232 are mounted generally rearwardly of the roller 24 and 222, respectively (as best shown in FIGS. 11 and 19). However, it should be appreciated that in an alternative embodiment, the grip releasing means could be disposed differently relative to the roller. For instance, in an alternative embodiment, the grip releasing means could be mounted substantially beneath the roller.

An exemplary use of the apparatus 20 is now described. The apparatus 20 is positioned on a floor 32 adjacent a flexible floor covering to be removed. A portion of the flexible floor covering having a width corresponding generally to the width of the intermediate portion 116 as measured between the ends 112 and 114, is manually detached from the floor using a utility knife, a box cutter, a scraper, or other similar tool and the detached portion is urged into engagement with the gripping means 28. With the gripping members 170 of at least one row 134 firmly gripping the detached portion of flexible floor covering, the drive assembly 26 is actuated to cause the roller 24 to rotate. As the roller 24 rotates about its rotational axis 'A-A' in a counter-clockwise direction (when viewed from the drive assembly side), the portion of the flexible floor covering 30 is pulled away from the floor and the apparatus 20 is thus urged to advance forward. The portion of flexible floor covering is directed toward the intermediate portion 116 by the circular plate members 140 and 142.

As the rows 134 of teeth 172 meet the plate member 190, the teeth 172 pass through the rebates 202. The plate member 190 prevents the portion of flexible floor covering 30 from following the rotational motion of the teeth 172 thereby causing the floor covering 30 to physically separate from the teeth 172. Thus detached from teeth 172, the floor covering tends to slide down the plate member 190 and accumulates on the floor 32 behind the apparatus 20.

Multiple passes of the apparatus 20 may be required to strip the floor covering from a floor having a relatively large surface area. The first pass of the apparatus 20 removes a band of flexible floor covering. Thereafter, each subsequent pass strips the adjacent band disposed side-by-side to earlier removed band, until the entire area has been stripped of its floor covering.

Although the foregoing description and accompanying drawings relate to specific preferred embodiments of the present invention as presently contemplated by the inventor, it will be understood that various changes, modifications and adaptations, may be made without departing from the spirit of the invention.

What is claimed is:

1. An apparatus for removing a flexible floor covering from a floor, the apparatus comprising:

a frame supported on a plurality of castors to allow rolling motion of the frame along the floor;

a roller supported on the frame for rotational motion relative thereto, the roller having an axis of rotation disposed substantially parallel to the floor when the apparatus is in use;

a drive assembly operatively connected to the roller for rotatively driving the roller;

gripping means carried on the roller for grippingly engaging a portion of the flexible floor covering; and grip releasing means for urging the gripping means to disengage from the portion of the flexible floor covering after the flexible floor covering has been detached from the floor, the grip releasing means being mounted to the frame and disposed adjacent the roller, the grip releasing means being operable to discourage the portion of the flexible floor covering from being wound about the roller.

2. The apparatus of claim 1 wherein:

the frame includes a pair of spaced apart, first and second longitudinal frame members and a cross-member extending between the frame members to join the first frame member to the second frame member;

the roller being mounted for rotation between the first and second frame members.

3. The apparatus of claim 2 wherein:

the roller has a cylindrical body; the cylindrical body having a first end, an opposed second end and an intermediate portion extending therebetween; the intermediate portion having a curved surface defining the circular cross-section of the cylindrical body; and the gripping means being carried on the curved surface of the intermediate portion.

4. The apparatus of claim 3 wherein the gripping means includes a plurality of spaced apart gripping members, each gripping member extending radially from the curved portion.

5. The apparatus of claim 4 wherein the gripping members are disposed about the intermediate portion in a plurality of spaced apart rows.

6. The apparatus of claim 5 wherein the plurality of rows includes at least three rows.

7. The apparatus of claim 6 wherein each row includes between five and twenty-five gripping members.

8. The apparatus of claim 7 wherein each row includes between ten and fifteen gripping members.

9. The apparatus of claim 8 wherein each gripping member is selected from the group consisting of: (a) a tooth; (b) a barb; and (c) a hook.

10. The apparatus of claim 4 wherein the gripping members are permanently fixed to the roller.

11. The apparatus of claim 4 wherein the gripping members are releasably mounted to the roller.

12. The apparatus of claim 11 wherein:

each gripping member includes a gripping portion and a fastening portion joined to the gripping portion for attachment to the roller; and the curved surface has a plurality of apertures defined therein for receiving the corresponding plurality of gripping members, the plurality of apertures being configured for threaded engagement with the corresponding plurality of fastening portions.

13. The apparatus of claim 1 wherein the drive assembly is manually operable.

14. The apparatus of claim 1 wherein the drive assembly is motorized.

15. The apparatus of claim 14 includes an electric drive motor operatively connected to the roller, the electric drive motor being supported on the frame.

16. The apparatus of claim 5 wherein:

the grip releasing means includes an elongate plate member having a first longitudinal edge for placement opposite the roller and a second longitudinal edge spaced apart from the first longitudinal edge;

the first longitudinal edge has formed therein a plurality of rebates corresponding to the plurality of gripping members in one of the plurality of the rows; and each rebate is disposed in alignment with its corresponding gripping member and is sized larger than its corresponding gripping member so as to allow its corresponding gripping member to pass therethrough unobstructed during rotation of the roller.

17. The apparatus of claim 16 wherein the plate member is mounted to extend longitudinally between the first and second frame members.

18. The apparatus of claim 17 wherein the plate member is disposed adjacent to the roller such that the first longitudinal edge thereof is substantially tangent to a portion of the curved surface of the cylindrical body.

19. The apparatus of claim 18 wherein, when the apparatus is in use, the plate member is slanted downwardly towards the floor.

20. The apparatus of claim 19 wherein, when the apparatus is in use, the first longitudinal edge is carried at a first height relative to the floor and the second longitudinal edge is carried at a second height relative to the floor; and the first height is greater than the second height.

21. The apparatus of claim 17 wherein the plate member is mounted generally rearwardly of the roller.

22. The apparatus of claim 5 wherein the grip releasing means includes a plate member having an elongate portion and at least one projection extending transversely therefrom, the at least one projection being disposed between adjacent gripping members.

23. The apparatus of claim 22 wherein:

the at least one projection includes a plurality of spaced apart projections;

the spacing between adjacent projections is aligned with the one gripping member and is sized larger than the one gripping member so as to allow the one gripping member to pass therethrough unobstructed during rotation of the roller.

24. The apparatus of claim 23 wherein the plate member is mounted to extend longitudinally between the first and second frame members.

25. The apparatus of claim 24 wherein, when the apparatus is in use, the plate member is slanted downwardly towards the floor.

26. The apparatus of claim 25 wherein:

each projection has a proximal end joined to the elongate portion and an opposed free end; and when the apparatus is in use, the free ends of the projections are carried at a first height relative to the floor and the proximal ends thereof are carried at a second height relative to the floor; the first height being greater than the second height.

27. The apparatus of claim 24 wherein the plate member is mounted generally rearwardly of the roller.

28. The apparatus of claim 23 wherein:

each projection has a proximal end joined to the elongate portion and an opposed free end; and the plate member is disposed adjacent to the roller such that the free ends of the projections are substantially tangent to a portion of the curved surface of the cylindrical body.

29. The apparatus of claim 3 further comprising means for guiding the portion of flexible floor covering towards the intermediate portion of the roller, the guide means being mounted to one of the roller and the frame.

30. The apparatus of claim 29 wherein the guide means includes a pair of first and second, spaced apart, guide plates; each guide plate being disposed adjacent one of the ends of the cylindrical body.

31. The apparatus of claim 30 wherein:

the guide plates are fixed to the frame members;

the first guide plate is attached to the first frame member; and the second guide plate is attached to the second frame member.

32. The apparatus of claim 29 wherein:

the guide plates are fixed to the roller;

the first guide plate is attached to the first end of the cylindrical body; and the second guide plate is attached to the second end of the cylindrical body.

33. The apparatus of claim 29 wherein the guide plates are circular.

34. The apparatus of claim 1 wherein the flexible floor covering is selected from a group consisting of: (a) a carpet; and (b) a resilient floor covering.

35. The apparatus of claim 34 wherein the resilient floor covering is selected from a group consisting of: (a) a vinyl covering; (b) a rubber covering; and (c) a cork covering.

* * * * *